United States Patent [19]

Schreter

[11] 3,950,823

[45] Apr. 20, 1976

[54] TIE CLASP

[76] Inventor: Arnold H. Schreter, 3310 Labyrinth Road, Baltimore, Md. 21215

[22] Filed: June 6, 1975

[21] Appl. No.: 584,455

[52] U.S. Cl. ..... 24/49 C; 24/255 TV
[51] Int. Cl.[2] ..... A44B 5/00; A41D 25/04
[58] Field of Search ..... 24/49 M, 49 TS, 49 CC, 24/255 TV

[56] References Cited

UNITED STATES PATENTS

| | | | |
|---|---|---|---|
| 2,472,190 | 6/1949 | Bievenouer | 24/49 C |
| 3,374,508 | 3/1968 | Slimovitz | 24/49 CC |

*Primary Examiner*—Paul R. Gilliam
*Assistant Examiner*—Doris L. Troutman
*Attorney, Agent, or Firm*—J. Wesley Everett

[57] ABSTRACT

The tie clasp is formed from a single sheet of spring metal and is secured to a narrow band by an adhesive strip, after which the band is secured at each end to the broad portion of a four-in-hand necktie, the distance between the stitches at each end of the band being such as to admit the small end of the tie between the portion of the tie and the band, the clasp itself having a slotted base portion and a folded spring clip folded over the slot in the base portion wherein the slot is substantially wider than the folded clip portion to allow a substantial distance on each side of the spring clip to provide ample space for the shirt material to be depressed into the slot between the inner surface of the base portion and the spring clip to increase the holding power of the clasp.

5 Claims, 12 Drawing Figures

TIE CLASP

The present invention relates to an improvement in a spring clip type of necktie clasp and in particular to a clasp that is capable of holding the heavier type of tie to a shirt.

One object of the present invention is to provide a necktie clasp of simple construction that is capable of holding a heavy tie to the front edge of a shirt.

Another object of the invention is to provide a spring type clasp without any sharp edges to engage the shirt material.

While several objects of the invention have been set forth, other objects, uses and advantages will become apparent as the nature of the invention is more fully disclosed in the following detailed description with reference to the accompany drawings, in which.

In referring to the drawing, like and similar reference characters refer to like and similar parts throughout the several views.

The clasp is particularly designed to be used with four-in-hand neckties which are at present time substantially larger and heavier than those formerly worn.

Figure 1:
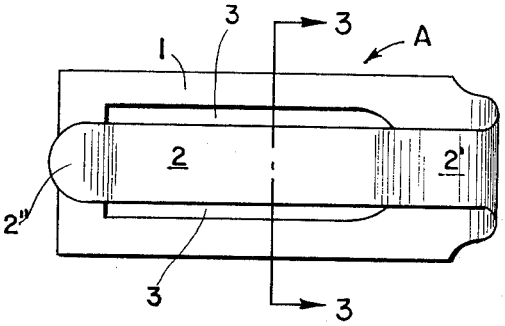
FIG. 1 is a top plan view of one form of the clasp.
Figure 2:
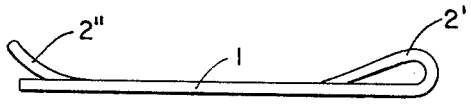
FIG. 2 is a side view of the same.
Figure 3:
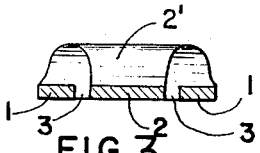
FIG. 3 is a sectional view taken on line 3—3 of FIG. 1.

Referring first to FIGS. 1, 2 and 3, the clasp A is formed from a single piece of spring metal and comprises a base portion 1 and a spring clip portion 2 formed at one end of the base portion 1, having a curved resilient section area 2′ and a free end section 2″. The base portion 1 is provided with a slot 3 which is substantially wider than the central section 2′ of the clip 2. The curved portion 2′ of the clip is formed in a long sweeping curve to give the whole area 2′ a uniform spring action. The central section of the clip 2 extends inwardly into the slot 3 and normally lies within a plane as shown best in FIG. 2, parallel with the plane of the base. In this position, the spring clip forces the shirt material inwardly into the slot 3 in the base portion to provide an increased non-slipping action between the clip 2 and the shirt material.

Figure 4:
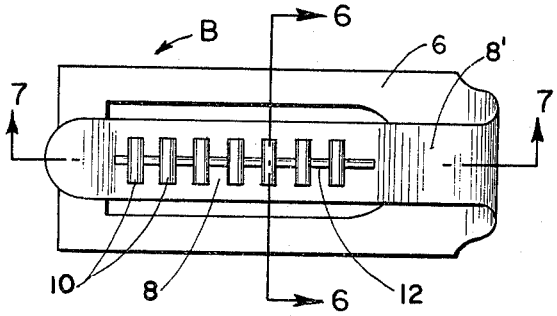
FIG. 4 is a top plan view of a modified form of clasp.
Figure 5:
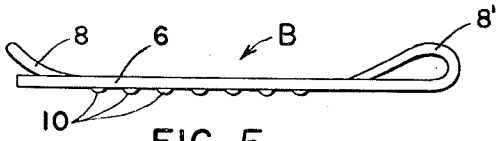
FIG. 5 is a side view of the clasp shown in FIG. 4.
Figure 7:
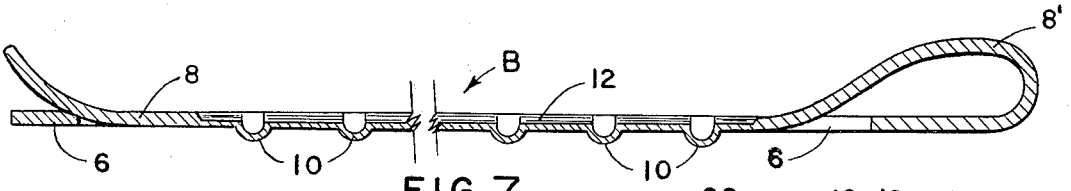
FIG. 7 is an enlarged sectional view of the clasp taken on line 7—7 of FIG. 4.
Figure 6:
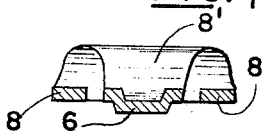
FIG. 6 is a sectional view of the clasp taken on line 6—6 of FIG. 4.

In the modified form B as shown in FIGS. 4, 5 and 6, the clip B is provided with a base portion 6, having a spring clip 8 formed in substantially the same manner as the clasp shown in FIGS. 1, 2 and 3, except the spring clip 8 is provided with a plurality of corrugations 10 extending throughout the length of the spring clip, as shown best in FIG. 4. The spring clip 8 is further provided with a rib 12 extending between the corrugations 10, for giving strength to the central portion of the clip to force the spring action to occur in the curved area 8′.

Figure 8:
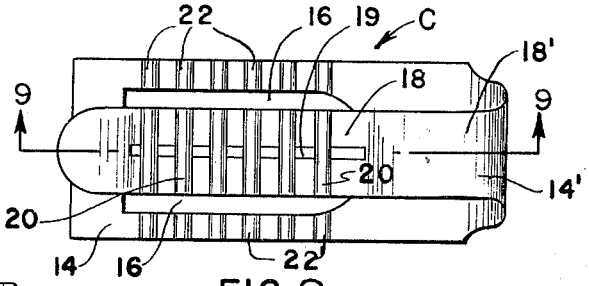
FIG. 8 is a top plan view of still another modified form of clasp.
Figure 9:
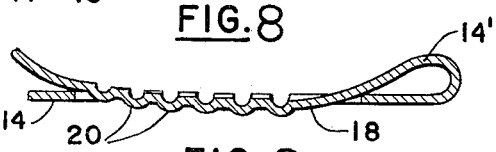
FIG. 9 is a sectional view taken on line 9—9 of FIG. 8.

FIGS. 8 and 9 show still a further modification C of the clasp. The general form of this modified form is similar to the two previously shown and described forms. In this form C the base portion 14 is also slotted as shown at 16. Formed integrally with the base is a spring clip 18 folded over the base and extending over the opening 16. In this form the corrugations 20 extend laterally across the entire width of the spring clip 18 which has a curved portion 18′.

The base portion 14 is also provided with corrugations 22 corresponding with the corrugations 20 carried by the spring clip. The spring clip 18 is also provided with a rib 19 extending centrally over the clip 18 and perpendicular to the corrugations for strengthening the section of the clip in engagement with the shirt.

Figure 10:
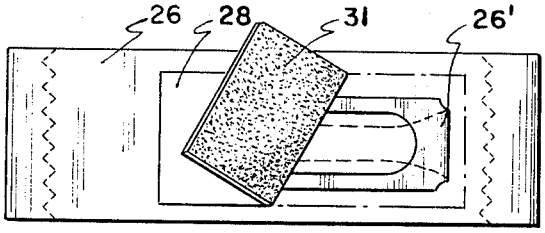
FIG. 10 is a bottom plan view of the clasp illustrating the manner in which the clasp is fixed to a supporting band.
Figure 12:
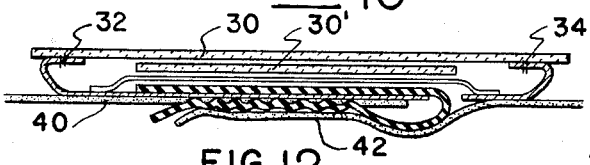
FIG. 12 is a longitudinal sectional view of the clasp attached to the tie and the shirt.
Figure 11:
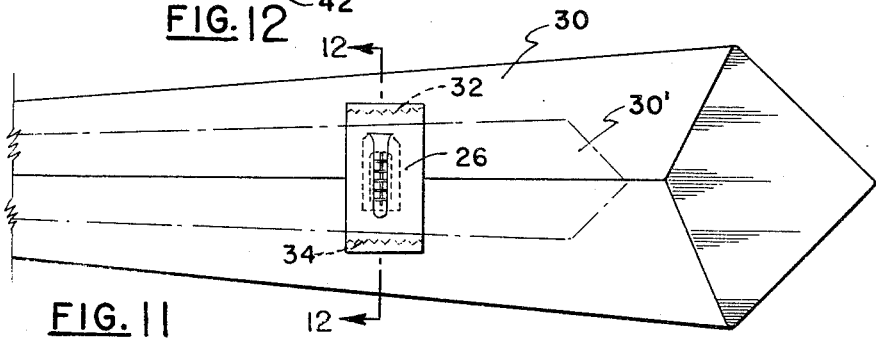
FIG. 11 shows the approximate location of the clasp after it is attached to the tie.

The clasp is attached to the necktie and the shirt as shown in FIGS. 11 and 12. The clasp is secured to the broad portion of a four-in-hand tie 30. The clasp is first attached to a strip of material 26 as shown in FIG. 10 by inserting the spring clip through a slit at 26′ after which a strip of adhesive tape 31 is attached to the under side of the strip 26 thereby covering the base portion of the clasp which leaves the base portion of the clasp secured to the side of the material 26 opposite the spring clip as shown in FIG. 10. After the clasp has been adhesively secured to the material, the strip of material and clasp are attached to the wide portion 30 of the tie, as shown in FIG. 11.

Referring in particular to FIG. 12 each end of the material strip 26 is attached to the tie portion by stitches 32 and 34 spaced apart a sufficient distance to allow the smaller end 30′ of the tie to extend through the space between the strip material 26 and the tie portion 30. The outer vertical edge 40 of the shirt is inserted between the material 26 supporting the base portion of the clasp and the the spring clip.

When the necktie is constructed of a light material the clasp as shown in FIGS. 1, 2 and 3 may be used, as the holding power of the clasp may not be required as in the case of heavier ties. However, if the ties are made of a heavy material and/or their size is substantially larger than the lighter weight tie, the spring clip must be made to hold the heavier tie to the shirt without too great a tension on the spring clip. This is done by corrugating the spring clips and reenforcing the clasp with a longitudinal rib, such as shown at 12 and 19 in FIGS. 4 and 8.

In the construction of the modified forms shown in FIGS. 4 to 9, the holding force of the clasp is greatly increased over the conventional tie clip with the same spring tension. This is important for the reason that the spring tension of the clip section should not be any greater than is necessary. It is also very desirable to have a spring clip that has no sharp edges or holding means that will prick or damage the shirt when the clasp is clipped thereto.

While the invention is shown and described in a particular form it is not intended as a limitation as the scope of the invention is best defined in the appended claims.

I claim:

1. A tie clasp of resilient metal having a base portion of elongated form and having an elongated slot extending longitudinally through the central portion thereof to a point adjacent one end of the base, a spring clip formed integrally with the base portion on the opposite end of the base portion and folded over the said slot adapted to engage the fabric of the open side of a shirt, the clip being substantially narrower than the slot and extending inwardly into the slot to a point where the clip is at least in a plane with the remaining portion of the base portion, a fabric strip for supporting the said clasp, the fabric strip having a slot adjacent one end thereof for receiving the spring clip, adhesive means for securing the outer side of the base portion of the clasp to one side of the fabric strip and means for securing the fabric strip to a necktie, the spring clip being of such width as to allow space for the shirt fabric to be forced into the slot about the lateral edges of the spring clip, the material forced into the slot being at least as far as the plane of the remainder of the base portion.

2. In a tie clasp as claimed in claim 1 wherein the spring clip is provided with a plurality of corrugations extending transversally of the clip.

3. In a tie clasp as claimed in claim 1 wherein the spring clip is provided with at least one corrugation extending longitudinally thereof.

4. In a tie clasp as claimed in claim 1 wherein the base portion extending along each side of the slot is provided with a plurality of corrugations.

5. In a tie clasp as claimed in claim 4 wherein the transverse corrugations in the spring clip are in line with the corrugations in the base portion.

* * * * *